United States Patent [19]

Michalski

[11] 4,349,712

[45] Sep. 14, 1982

[54] PUSH-BUTTON SWITCH

[75] Inventor: Dieter Michalski, Berlin, Fed. Rep. of Germany

[73] Assignee: ITT Industries, Inc., New York, N.Y.

[21] Appl. No.: 113,792

[22] Filed: Jan. 21, 1980

[30] Foreign Application Priority Data

Jan. 25, 1979 [DE] Fed. Rep. of Germany ..... 2902769

[51] Int. Cl.[3] ..... H01H 13/04

[52] U.S. Cl. ..... 200/159 B; 200/5 A

[58] Field of Search ..... 200/159 B, 5 A, 5 E, 200/73, 67 D, 67 DA

[56] References Cited

U.S. PATENT DOCUMENTS

| | | | |
|---|---|---|---|
| 3,617,660 | 11/1971 | Krakinowski | 200/159 B |
| 3,917,917 | 11/1975 | Murata | 200/159 B |
| 4,046,975 | 9/1977 | Seeger, Jr. | 200/5 A |
| 4,066,851 | 1/1978 | White et al. | 200/159 B |
| 4,081,898 | 4/1978 | Taylor, Jr. et al. | 200/159 B |
| 4,127,752 | 11/1978 | Lowthorp | 200/159 B |
| 4,145,584 | 3/1979 | Otterlei | 200/159 B |
| 4,152,563 | 5/1979 | Bongort | 200/67 DA |
| 4,194,105 | 3/1980 | Hodges | 200/159 B |
| 4,304,973 | 12/1981 | Fenellie et al. | 200/159 B |

FOREIGN PATENT DOCUMENTS

| | | | |
|---|---|---|---|
| 2018024 | 10/1979 | United Kingdom | 200/5 A |

*Primary Examiner*—Willis Little

*Attorney, Agent, or Firm*—James B. Raden; William J. Michals

[57] ABSTRACT

A push-button switch using one dome sheet of plastics with an electrode on one face and a second flat sheet of plastics with an electrode on the face opposite the first one. Between the sheets and below the second one plates of rigid material with holes below the dome are arranged. When the button is depressed the dome snaps over to the other side of the plastic sheet and the electrode contacts the electrode on the flat plastic sheet. By the hole in the plate below the flat sheet a chatter-proof contact is established.

1 Claim, 12 Drawing Figures

PUSH-BUTTON SWITCH

Figure 1:
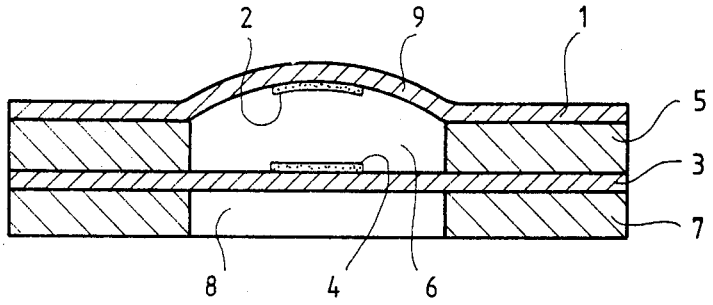

The present invention relates to a push-button switch comprising a base of insulating material with an interconnection pattern, a holed intermediate layer arranged thereon, and a sheet of plastics arranged on this intermediate layer, with another interconnection pattern arranged on the bottom side thereof in which snappable domes not facing the base, but corresponding to the holes in the intermediate layer, are shaped, so that parts of the interconnection pattern on the base of insulating material and of the sheet of plastics in the holes of the intermediate layer establish an electrical contact with one another upon depressing the domes. Such types of switches are known from the German Auslegeschrift (DE-AS) No. 2 448 587.

Moreover, there are known push-button switches in which two diaphragms with a holed intermediate layer, form a hermetically sealed space (German Offenlegungsschrift (DE-OS) No. 2 238 026).

Finally, there are known low-profile (flat) push-button switches employing diaphragms of plastic sheets, in which a lightsource is arranged on the side not facing the side of actuation, so that the arrangement is illuminated through the sheets (German Offenlegungsschrift (DE-OS) No. 2 623 930).

In the conventional arrangement according to the aforementioned German Auslegeschrift (DE-AS) No. 2 448 587, the sheet which is provided with the snappable dome, cooperates with the contacts which are arranged on a rigid circuit board disposed therebelow. In such a type of push-button switch, the contact pressure largely depends on the actuating pressure exerted upon the snappable dome, because the opposite contact is arranged on a rigid and nonflexible base. This is also one reason why these types of push-button switches are not chatter-proof.

In the type of embodiment according to the German Offenlegungsschrift (DE-OS) No. 2 238 026 there are used metal diaphragms which are expensive in manufacture and have to be electrically insulated with respect to one another.

In the push-button switch according to the German Offenlegungsschrift (DE-OS) No. 2 623 930 there is not provided a snappable dome in the sheet of plastics, and there is used instead a piezoelectric sheet of plastics of flat shape.

The invention starts out from the conventional type of push-button switch as disclosed in the German Auslegeschrift (DE-AS) No. 2 558 587.

It is the object of the invention to design such a switch to become chatterless and, by proposing a simplified construction, to substantially simplify the manufacture of such a switch.

With respect to a switch of the type mentioned hereinbefore, this object is achieved by taking the measures set forth in the characterizing part of claim 1.

Advantageous further embodiments of the invention are set forth in the sub-claims.

In distinction to the conventional type of embodiment, the dome of the sheet of plastics, when snapping over, meets upon the sheet lying therebeneath, which is not supported on a firm base but is arranged in a freely floating manner between two hold members. By exerting pressure upon the snappable dome, there is not only established the contact between the two sheets, but the lower sheet is also arched to some extent, so that upon closure of the two contacts, the two sheets still perform a further movement. Owing to the fact that the snappable dome meets upon the likewise movable second sheet, there is avoided a chatter (contact bounce), and owing to the additional further movement of the two sheets, after having established a contact with one another, the two contact surfaces also move laterally so as to have a wiping effect on the surfaces. This wiping motion has a continuous self-cleaning effect each time the contact is actuated. This wiping motion also has the effect of removing the extremely thin resistance layers of contamination and oxide material which are otherwise formed on the contact surfaces. This results in the establishment of a good electrical contact with a low transfer resistance which not increases even after frequent actuation.

Moreover, owing to the arching of the second sheet, an additional resetting force is exerted upon the dome, thus causing an exact snapping back of the dome as soon as pressure decreases. At the same time, and as desirable in many cases, the contact is not immediately interrupted in the course of this, but still remains completed for a part of the way during the backward movement of the sheets. The contact force of the switch according to the invention chiefly only depends on the snap-over force of the dome of the sheet of plastics, and not on the actuating pressure as is the case with a switch in which the opposite contact is arranged on a rigid base.

Owing to the fact that the sheets which are coated with contacts are capable, on one hand, of freely oscillating within the holes and, on the other hand, that the sheets are firmly clamped in position outside the holes, it is possible to arrange a large number of switches according to the invention next to each other without these switches mutually affecting each other, and to manufacture them in a very simple way. The construction according to the invention results in a very low-profile (flat) switch which can be easily mounted in the front panel of an electrical household appliance or any other device, and which is very reliable under continuous duty conditions.

Figure 2:
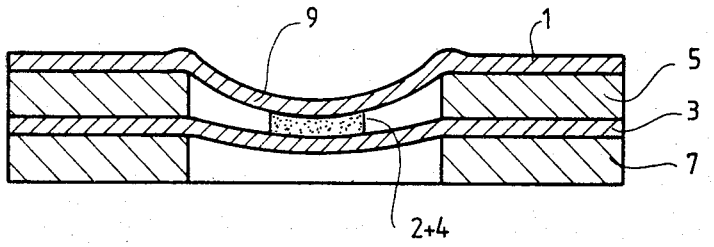
Figure 3:
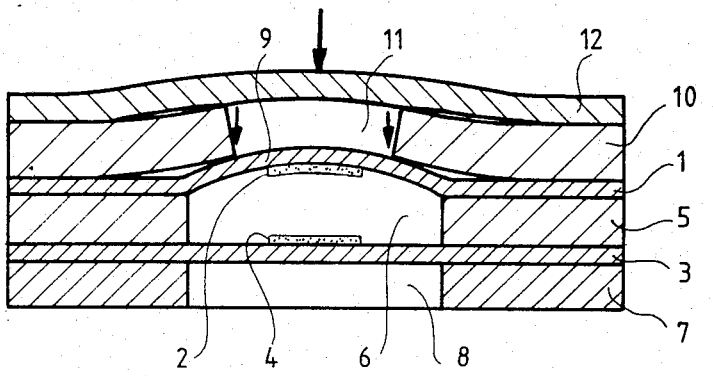
Figure 4:
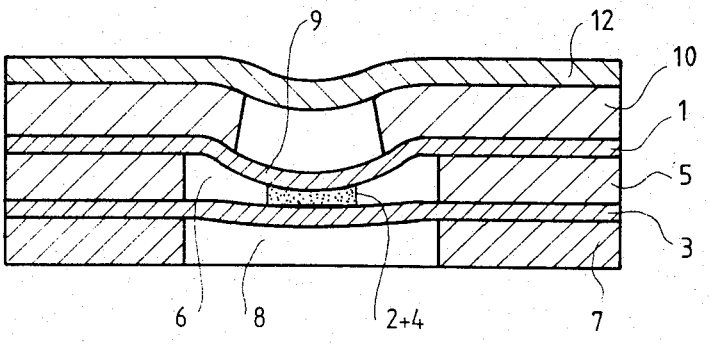
Figure 5:
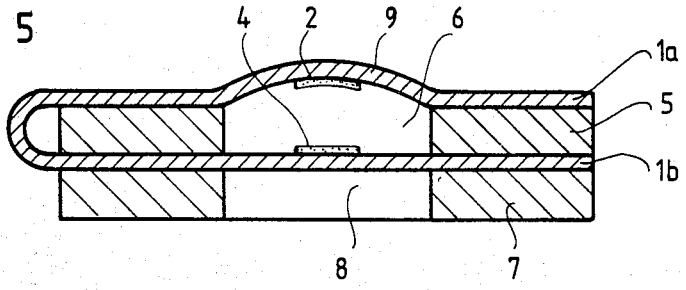
Figure 6:
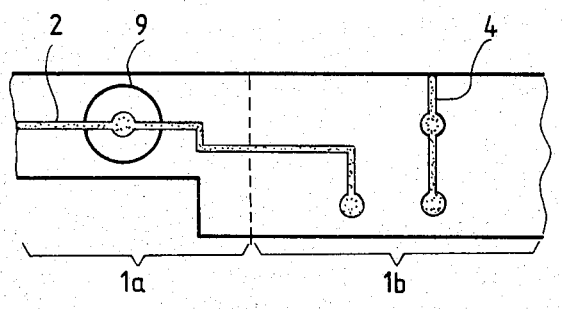
Figure 10:
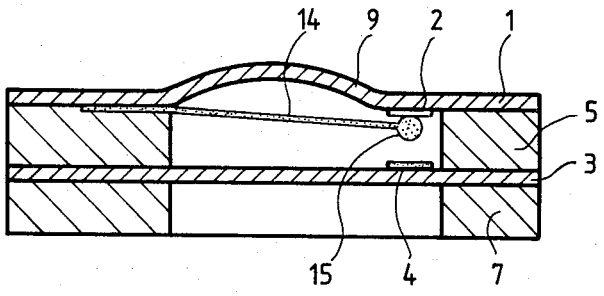
Figure 11:
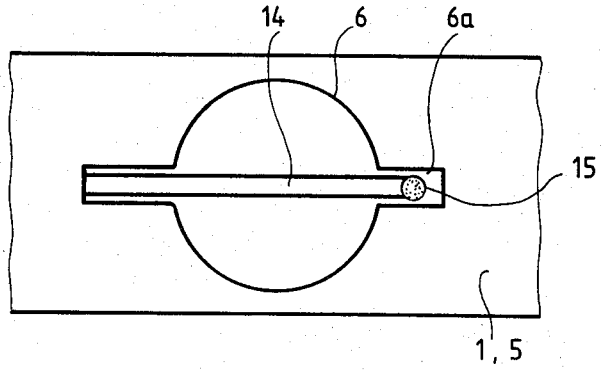
Figure 12:
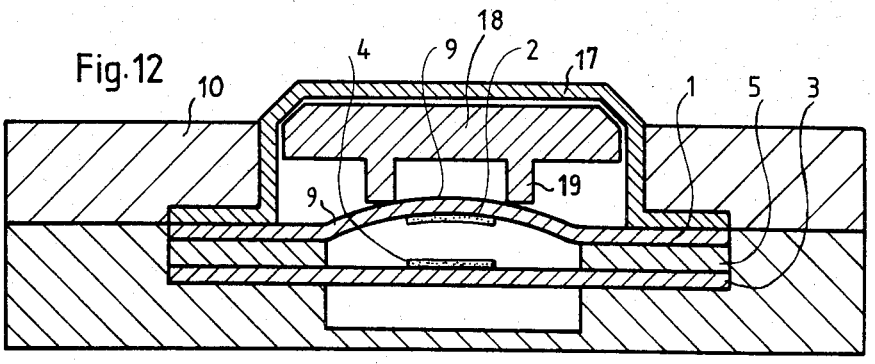

The invention as well as advantageous further embodiments thereof will now be explained in greater detail with reference to FIGS. 1 to 12 of the accompanying drawings in which:

FIG. 1 is the sectional view of a switch according to the invention in the non-actuated state while FIG. 2 shows the same switch as FIG. 1 in the actuated state, FIGS. 3 and 4 show a further type of embodiment of the switch according to the invention in both the non-actuated and the actuated state, FIG. 5 is the sectional view of a further type of embodiment according to the invention, FIG. 6 is the top view of a sheet of plastics as used with a switch according to FIG. 5, FIGS. 7, 8, 9 and 10 show further types of embodiment of the switch according to the invention, in sectional representations, FIG. 11 is the top view of a part of the switch according to FIG. 10, and FIG. 12 is the sectional view of a modified type of embodiment according to FIG. 3.

First, it should be pointed out that the drawings only schematically show the construction of a switch according to this invention, and that the thickness relationships of the individual parts are distorted for the sake of enabling a better understanding, and to not correspond to actual conditions.

The switch according to FIG. 1 consists of a sheet of plastics 1 which is provided on one side with an interconnection pattern 2 preferably applied thereto by employing a printing process. Into the sheet 1 there is formed a snappable dome 9 which is so designed that it, in response to a pressure exerted thereupon, suddenly snaps over towards the inside, as is shown in FIG. 2. Upon relieving the pressure upon the dome 9, the latter snaps back into its initial position.

The sheet of plastics 1 is arranged on an intermediate layer 5 which may consist of a thin plate or sheet provided with a hole 6 within the area of the dome 9 of the sheet of plastics 1. Below the intermediate layer 5 there is arranged a further sheet of plastics 3 provided on one side with an interconnection pattern 4. These interconnection patterns on both sheets 1 and 3 are so designed and arranged that conducting parts on the two sheets oppose one another on the two sheets within the area of the dome 9, as is shown in FIG. 1. Below the sheet 3 there is arranged a rigid carrier plate 7 having the shape of a thin plate and provided with a hole 8 within the area of the dome 9. The individual parts are firmly connected to one another in a suitable way, for example, by layers of adhesive arranged between them. Manufacture is particularly simple when using an intermediate layer 5 which is provided on both sides with a layer of adhesive. The rigid carrier plate 7 does not need to be absolutely bonded to the sheet 3, in fact, it is sufficient in many cases for it to be retained in the proper position with respect to the other parts by taking suitable steps.

When the snappable dome type push-button 9 is depressed, this dome is caused to snap over towards the inside, as is shown in FIG. 2. In the course of this, the conducting parts 2 and 4 come into contact with one another, thus establishing an electrical connection between them. Contact pressure is substantially determined by the snap-over pressure of the dome 9, exerting a pressure against the movable part of the sheet 3, somewhat arching the latter in the downward direction, as is seen in FIG. 2. Since the opposite contact 4 is disposed on that part of the sheet 3 which is arranged movably within the contact area, there is achieved a completely chatterproof contacting, and at the same time, owing to the slight lateral motion of the two contact surfaces 2 and 4 with respect to one another, there is achieved a self-cleaning of the contact surfaces during each switching process. The bent-through sheet 3 simultaneously increases the resetting force for the snappable dome 9.

As can be seen from FIGS. 1 and 2, the switch according to the invention has an extremely simple construction and is easy and simple to manufacture. The switch is completely insulated towards the outside thus preventing the conductors 2 and 4 from being touched. By connecting the individual parts with one another there results a hermetic seal towards the outside, so that the switch remains fully functionable also under unfavorable operating conditions (such as in a damp atmosphere).

One advantageous further embodiment of the switch according to the invention is shown in sectional view in FIGS. 3 and 4. This switch construction differs from the one as shown in FIGS. 1 and 2 in that a sheet 10 provided with a hole is arranged on the snappable dome 9, with this sheet 10, in turn, being covered by a sheet 12. The sheet 10 has a hole with a diameter smaller than that of the dome 9 of the sheet 1, and is arranged concentrically in relation to this dome 9. This results in an arrangement in which the walls of the hole 9 in the sheet 10 come to lie on the dome 9, as is shown e.g. in FIG. 3. A further unholed sheet 12 is arranged on the sheet 10, id est in such a way that in the non-actuated state, there will remain a spacing between the sheet 12 and the dome 9 provided for in the sheet of plastics 1. Actuating pressure is now exerted upon the sheet 12, as is indicated by the arrow. The pressure exerted upon the sheet 12 is transferred via the walls of the hole 11 in the sheet 10 to the dome 9, somewhat as indicated by the arrows. Accordingly, in this type of embodiment, pressure is not exerted upon the center of the dome 9 but more towards the edge or rim portion of the dome 9. In this way there is performed a kind of lever action (leverage), that is, the distance to be travelled by the sheet 12 for causing the dome 9 to snap over is shorter than the distance of actuation necessary for causing the dome 9 to snap over in cases where pressure is exerted directly upon the center of the dome. In addition thereto, in this type of embodiment the deformations of the dome 9 which, finally, lead to a snap-over, extend annularly from the rim portion of the dome, with this leading to a quicker snap-over of the center portion of the dome 9. The snapping upon actuation of the switch becomes better perceptible than without the use of the sheets 10 and 12. Hence, in this arrangement, the pressure point is fixed, whereas in the case of a direct pressure exerted upon the dome 9 with the finger, the pressure may be exerted either upon the center or somewhat away therefrom, hence also asymmetrically. In this way the snap-over of the dome 9 becomes substantially better reproducible. From the flat covering sheet 12 there results a smooth outer surface as well as an additional insulation with respect to the conducting parts 2 and 4 and, consequently, an improved mechanical protection of the entire switch.

FIG. 4 shows the type of embodiment according to FIG. 3 in the snapped-over state. Also from this illustration it can be seen that the sheet 2 is somewhat bent within the hole 8, so as to result in a chatterproof contacting and, simultaneously, in a self-cleaning of the contacts. Moreover, it can be seen from FIG. 4 that the arching on the surface of the sheet 12 is smaller than that of the dome 9.

FIG. 5 is the sectional view of a further type of embodiment of the switch according to the invention resulting in a substantial simplification of the manufacture. Instead of the sheets 1 and 3 according to FIG. 1 on which the interconnection patterns 2 and 4 are arranged, there is only used one single sheet in the type of embodiment according to FIG. 5, which is folded around the intermediate layer 5. In this FIG. 5, the two parts of the sheet are indicated by the reference numerals 1*a* and 1*b*. Otherwise, the switch is composed of the same parts as described hereinbefore and, of course, may also be further constructed in the way as described with reference to FIGS. 3 and 4, or still further as described with reference to the following drawings.

It will be seen that a substantial manufacturing advantage will result when using one single sheet.

One example relating to a sheet suitable for being used in the construction according to FIG. 5, is shown in a top view in FIG. 6. The interconnection patterns 2 and 4 are deposited, e.g. printed on the one side of the sheet in the course of one single step of the process. Thereafter, the snappable dome is formed at 9, e.g. by way of deep drawing. Finally, the sheet is folded around the intermediate layer 5 along the dashed line in such a way that the dome 9 will come to lie above the hole 6. As is evident from FIG. 6, the sheet may still be provided with a cutout in the part 1*a*, so that the electrical connections for the two interconnection patterns 2 and 4 remain accessible after the folding. Manufacture of such a switch is extremely simple when the intermediate layer 5 is provided on both sides with a layer of adhesive. Relative thereto, it still has to be considered that such switches, as a rule, are not manufactured and used individually, but that arrangements comprising a plurality of switches arranged in one plane are required, which result in a keyboard of the type as used, for example, with electronic handheld (pocket) calculators. Printing the interconnection patterns and the deep-drawing of the domes is then carried out in the course of one single operating step with one single sheet, and after the sheet has been folded around the holed intermediate layer 5 and placed on a holed carrier plate 7, the entire keyboard (keypad) is finished. In so doing, the individual push-button switches are arranged, as a rule, to have the shape of coordinates, with e.g. a plurality of contacts 2 lying in one row and electrically connected to one another, and a plurality of contacts 4 lying in one column and likewise electrically connected to one another. By exerting a pressure upon one switch, one row is then electrically connected to one column.

Figure 7:
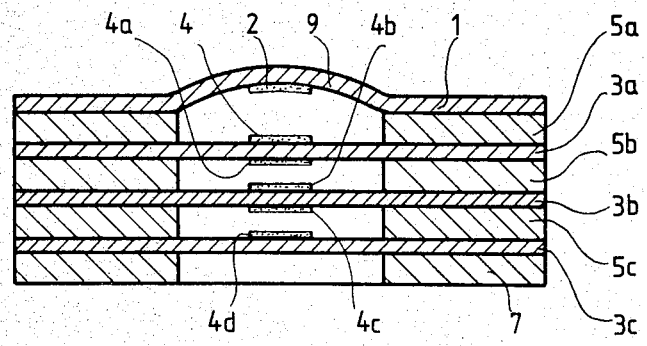

FIG. 7 shows a further type of embodiment of the push-button switch according to the invention. Here, instead of the sheet 3 as with the previously described switches, there are provided several sheets 3*a*, 3*b* and 3*c* which are all provided with electrical interconnection patterns, id est in distinction to the previously described types of embodiment, partly on both sides. Thus, for example, the sheet 3*a* is provided with the interconnection pattern 4 and 4*a*, and the sheet 3*b* is provided with the interconnection pattern 4*b* and 4*c*. The sheet 3*c* is only provided with one single interconnection pattern 4*d*. Between the individual sheets there are arranged intermediate layers 5*a*, 5*b* and 5*c*, while the entire arrangement rests on the rigid carrier plate 7. Both the intermediate layer and the carrier plate are again provided with holes corresponding to the dome 9. Dimensions of the intermediate layers of the sheets and of the path of the dome 9 are chosen thus that upon a snap-over of the dome 9 there is not only established an electrical contact between the interconnection patterns 2 and 4, but also the sheets 3*a*, 3*b* and 3*c* are arched in such a way that the respective contacts lying opposite each other on the individual sheets come into contact with one another. In this way it is possible to release several switching processes by initiating one single snap-over process, with the individual pairs of contacts being insulated from one another. Also in this type of embodiment, of course, the sheets 1 and 3*a* as well as the sheets 3*b* and 3*c* may each be combined to form one single sheet which is then folded in the way as shown in FIG. 5. Of course, it is also possible to combine the sheets 1 and 3*c* and the sheets 3*a* and 3*b* to form one single sheet.

Figure 8:
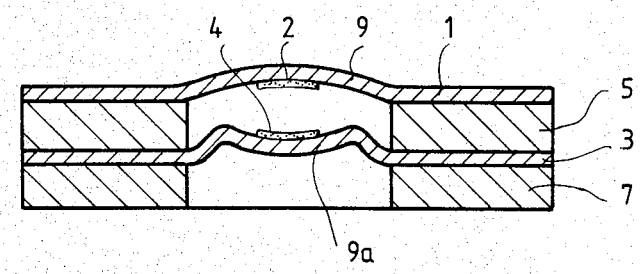
Figure 9:
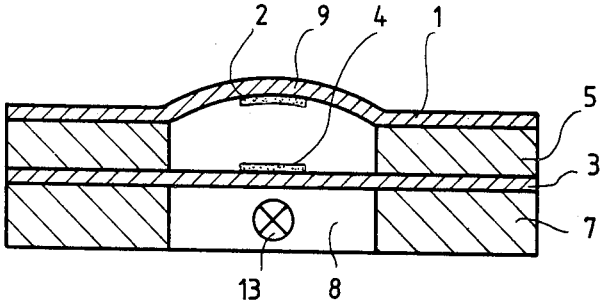

A dome 9*a* is also shaped into the sheet 3 in the type of embodiment as shown in FIG. 8, but this dome 9*a* is so designed as not to snap over. The center part of the dome 9*a* is again formed by a flexible abutment for the snapped over dome. In this type of embodiment the movability of the sheet 3 is restricted to a partial range within the holes as provided for in both the intermediate layer and the carrier plate.

When the sheets in the switch according to the invention are made of a transparent material, a light source 13 may be arranged on the bottom side, preferably within the hole 8 in the rigid carrier plate 7, so that the individual switches are illuminated from the rear side. It is also possible, however, to arrange one light source in common to a plurality of switches, below the rigid carrier plate 7. In order to designate the individual switches in cases where a plurality of switches are employed, a suitable symbol, such as a numeral or a letter may be printed on the sheets, for example, on the sheet 9. It is of particular advantage for the symbol to be printed on the inside of the sheet of a switch, as then it cannot be damaged or gradually wiped away in the course of actuating the switch. It is particularly simple to form the symbol by one of the interconnection patterns 2 or 4 themselves. Thus, for example, the interconnection pattern 2 may be designed to have the shape of a numeral or of a letter, and then not only has the function to establish an electrical contact with the interconnection pattern 4, but symbolizes at the same time what switch is concerned. Of course, the symbol may also be printed on an additional sheet which, as for example, in the embodiment according to FIG. 3, is inserted between the sheets 12 and 10. In this way the symbol is easily interchangeable without having to open the contact portion of the switch.

With the switch according to the invention it is also possible to form a change-over contact in such a way that a contact spring is inserted between the sheet 1 and the intermediate layer 5, with this contact spring being acutated by the snapping over of the dome 9. One such type of embodiment is shown in a sectional view in FIG. 10, and in a top view in FIG. 11. This contact spring is clamped with one side between the sheet 1 and the intermediate layer 5, and, in the non-actuated state of the switch, with the aid of its contact 15, establishes an electrical contact with the interconnection pattern 2 on the bottom side of the sheet 1. Upon snapping over of the dome 9 the contact spring 14 is pushed downwardly and now establishes a contact with the interconnection pattern 4 on the top side of the sheet 3. For this purpose it is appropriate to provide the hole 6 in the intermediate layer 5 with an extension 6*a* in which the contacts are arranged, as can be seen from FIG. 11.

FIG. 12, in a sectional view, shows the modification of the type of embodiment according to FIG. 3. In this case the sheet 10 has a hole 16 of a diameter larger than that of the dome 9. Into the hole 16 there is inserted a cap 17 of a deformable material, id est in such a way as to result in a tight sealing of the switch. Between the cap 17 and the dome 9 there is arranged a contact piece 18 made of a rigid material which, with its annular shoulder 19 rests on.

What is claimed is:

1. A push-button switch comprising:

a bottom layer of rigid insulating material, said bottom layer having a plurality of openings therethrough extending from the top to the bottom surface thereof, a first base layer of resilient and flexible plastic arranged on the bottom layer;

a plurality of electrically conductive contacts supported on the side of said base layer which faces away from said bottom layer, each contact in register with at least one different opening in said bottom layer;

an intermediate layer of rigid insulating material having a plurality of openings therethrough extending from the top to the bottom surface thereof and said intermediate layer being arranged on the contact side of said base layer with each opening in said intermediate layer in register with at least one different contact on said base layer;

a second base layer of resilient and flexible plastic arranged on said intermediate layer;

a plurality of electrically conductive contacts supported on the side of said second base layer which faces said contacts on said first base layer with each contact on said second base layer in register with a corresponding contact on said first base layer; and, wherein the portions of said second base layer overlying said openings thereunder are domed with a convex curved surface to provide snappable surfaces, wherein inwardly deflection of said domed surfaces provides electrical engagement of the corresponding contacts in register therewith and a corresponding inward deflection of the portions of said first base layer which overlie said openings in said bottom layer, and wherein all adjacent ones of said openings are separated by respective portions of rigid bottom and intermediate layers whereby the portions of said base layers between adjacent openings are firmly clamped in position.

* * * * *